US011691045B2

(12) United States Patent
Sargent et al.

(10) Patent No.: US 11,691,045 B2
(45) Date of Patent: Jul. 4, 2023

(54) TROLLEY APPARATUS, SYSTEM, METHOD OF USE, AND METHOD OF MANUFACTURE

(71) Applicant: eBrands Global Oy, Helsinki (FI)

(72) Inventors: Nathan Thomas Sargent, Oceanside, CA (US); Riley N. Sargent, Oceanside, CA (US); Tate A. Sargent, Oceanside, CA (US)

(73) Assignee: eBrands Global Oy, Helsinki (FI)

( * ) Notice: Subject to any disclaimer, the term of this patent is extended or adjusted under 35 U.S.C. 154(b) by 0 days.

(21) Appl. No.: 17/493,399

(22) Filed: Oct. 4, 2021

(65) Prior Publication Data

US 2023/0109554 A1 Apr. 6, 2023

(51) Int. Cl.
*A63B 7/08* (2006.01)

(52) U.S. Cl.
CPC ..... *A63B 7/085* (2013.01)

(58) Field of Classification Search
CPC ..... A63B 7/00; A63B 7/085; A63B 2210/50; A63B 2225/09; A63B 7/02; A63G 21/20; A63G 31/00; A63G 21/2031; F16B 45/02
See application file for complete search history.

(56) References Cited

U.S. PATENT DOCUMENTS

| | | | | |
|---|---|---|---|---|
| D30,347 | S | 3/1899 | Williams | |
| D45,911 | S | 6/1914 | Mallory | |
| D55,508 | S | 6/1920 | Flynn, Jr. | |
| 3,026,816 | A * | 3/1962 | Russo | A63G 21/20 105/148 |
| D202,294 | S | 9/1965 | Heifetz | |
| D209,013 | S | 10/1967 | Pike | |
| 4,062,293 | A | 12/1977 | Davis | |
| D275,365 | S | 9/1984 | Kanemitsu | |
| D308,012 | S | 5/1990 | Kanemitsu | |
| D308,013 | S | 5/1990 | Kanemitsu | |
| D317,709 | S | 6/1991 | Kanemitsu | |

(Continued)

FOREIGN PATENT DOCUMENTS

| | | | | |
|---|---|---|---|---|
| DE | 202011103593 | * 7/2010 | ..... | A63B 7/08 |
| DE | 202011103593 | * 11/2011 | ..... | A63B 7/08 |

(Continued)

OTHER PUBLICATIONS https://www.amazon.com/HOKINETY-Ninja-Slackline-Pulley-Kit/dp/B09L4PK95Q/ref=sr_1_7?crid=3IME21TLB75YM&keywords=hokinety+ninja+warrior+obstacle+course+for&qid=1641835101&s=toys-and-games&sprefix=hokinety+ninja+warrior+obstacle+course+fo%2Ctoys-and-games%2C105&sr=1-7 (Year: 2021).*

(Continued)

*Primary Examiner* — Andrew S Lo
*Assistant Examiner* — Andrew M Kobylarz

(57) ABSTRACT

A trolley apparatus, system, and method of manufacture are described herein. The trolley apparatus may comprise one or more of a first side plate, a second side plate, a support axle, one or more roller components, and/or other components. The support axle may be mounted through and/or between the first side plate and the second side plate. The support axle may be mounted such that the first side plate and the second side plate are at opposite ends of the support axle. The support axle may be configured to support the one or more roller components. In some implementations, the trolley apparatus may be specifically configured to accommodate a slackline webbing which may have a width of about five centimeters.

20 Claims, 8 Drawing Sheets

(56) References Cited

U.S. PATENT DOCUMENTS

| | | | | |
|---|---|---|---|---|
| D320,927 | S | 10/1991 | Kanemitsu | |
| 5,119,735 | A | 6/1992 | Jang | |
| 5,931,100 | A | 8/1999 | Sutton | |
| D431,771 | S | 10/2000 | Westerfield | |
| D436,561 | S | 1/2001 | Louden | |
| 6,669,135 | B1 | 12/2003 | Hartley | |
| 6,810,818 | B2 | 11/2004 | Petzl | |
| D554,017 | S | 10/2007 | Hampton | |
| 7,966,941 | B1 * | 6/2011 | Brannan | B60T 11/046 104/53 |
| D645,334 | S | 9/2011 | Kanemitsu | |
| 8,234,980 | B2 * | 8/2012 | Boren | A63G 21/22 104/53 |
| D669,343 | S | 10/2012 | Pesch | |
| D685,676 | S | 7/2013 | Tylaska | |
| D687,700 | S | 8/2013 | Petzl | |
| 8,640,626 | B2 * | 2/2014 | Perry | F16H 7/18 472/49 |
| 8,851,232 | B2 | 10/2014 | Raoul Bingham | |
| D757,524 | S | 5/2016 | Eide | |
| 9,707,976 | B2 | 7/2017 | Strasser | |
| D797,828 | S | 9/2017 | Nakamura | |
| D819,434 | S | 6/2018 | Sonneman | |
| 10,092,788 | B2 * | 10/2018 | O'Brien | A63B 7/00 |
| D833,856 | S | 11/2018 | Simonds | |
| D860,766 | S | 9/2019 | Brown | |
| D860,773 | S | 9/2019 | Hawthorne | |
| D862,205 | S * | 10/2019 | Bailey | D8/356 |
| D869,263 | S | 12/2019 | Cowell | |
| D874,553 | S | 2/2020 | Costa | |
| 10,578,202 | B2 | 3/2020 | Burdeshaw | |
| 10,654,498 | B2 | 5/2020 | Runia | |
| D893,286 | S * | 8/2020 | Xu | D8/360 |
| D896,352 | S | 9/2020 | Horning | |
| D908,475 | S | 1/2021 | Grobe | |
| D920,083 | S * | 5/2021 | Yu | D8/360 |
| 11,007,947 | B2 | 5/2021 | Gandhi | |
| D930,460 | S | 9/2021 | Sun | |
| D932,109 | S | 9/2021 | Auston | |
| D936,462 | S * | 11/2021 | Cao | D8/360 |
| D951,073 | S | 5/2022 | Lee | |
| D952,447 | S | 5/2022 | Jang | |
| D971,008 | S | 11/2022 | Yamazaki | |
| 2009/0114893 | A1 | 5/2009 | Lange | |
| 2009/0223406 | A1 * | 9/2009 | Smith | A63G 21/22 104/112 |
| 2011/0239898 | A1 * | 10/2011 | Brown | B61B 12/02 29/428 |
| 2016/0325130 | A1 | 11/2016 | Grund | |
| 2017/0319887 | A1 | 11/2017 | O'Brien | |
| 2018/0001126 | A1 * | 1/2018 | Klopman | A61B 5/681 |
| 2018/0185690 | A1 | 7/2018 | Coulter | |
| 2018/0326957 | A1 * | 11/2018 | McGowan | A63G 21/22 |
| 2020/0385028 | A1 | 12/2020 | Quillard | |

FOREIGN PATENT DOCUMENTS

| | | |
|---|---|---|
| EM | 0015360950001 | 6/2009 |
| EM | 0015360950002 | 6/2009 |
| EM | 0015360950003 | 6/2009 |
| EM | 0015360950004 | 6/2009 |
| EM | 0015360950005 | 6/2009 |
| EM | 0015360950006 | 6/2009 |
| EM | 0061260580001 | 2/2019 |
| WO | 2011078460 | 6/2011 |

OTHER PUBLICATIONS https://www.amazon.com/Fofana-Ninja-Slider-Slackline-Pulley/dp/B08X1R6335/ref=pb_allspark_dp_sims_pao_desktop_session_based_2/135-0296868-0391951?pd_rd_w=tUL1s&pf_rd_p=e896123b-6614-49c5-873e-d532e726c2f0&pf_rd_r=6H5Y7ZJBF2Y4YMRS681Z&pd_rd_r=8dd8d402-0a9f-405e-a30f-895347e13739&pd_rd_wg=4tN7N&pd_rd_i= (Year: 2021).* https://www.amazon.com/Slackline-Ziplines-Backyards%EF%BC%8CZipline-Accessories-Kit%EF%BC%8CNinja/dp/B08V5JRFJJ?th=1 (Year: 2021).* https://www.ubuy.co.in/product/D68SQ06-jugader-ninja-warrior-obstacle-course-for-kids-with-slide-pulley-50ft-ninja-slackline-with-climbing; Apr. 4, 2021; Jugador (Year: 2021).*

FeetOffTheGround; "Highway Line Slide/Webbing Pulley" https://feetoffground.com.au/product/highway-line-slide-webbing-pulley/ [retrieved from the internet on Oct. 6, 2021] Aug. 20, 2019 (4 pages).

Krzysztof Bukolt, GrabCad.com "Webbing Pully—Prototype of pulley for slackline" https://grabcad.com/library/webbing-pulley-1 [retrieved from the internet on Oct. 6, 2021] Jul. 23, 2017 (4 pages).

Liftec Rigging; "Pulley Blocks Pulley Single Sheave Webbing Light Duty With Bronze Bush Bearing" http://www.chinaliftec.com/products/pulley_blocks/434.html [retrieved from the internet on Oct. 6, 2021] Sep. 29, 2015 (2 pages).

Petram Slackline "Motum Pulley" https://www.facebook.com/Petram.Slackline/posts/motum-pulley-webbing-pulley-for-transport-on-slackline-or-as-an-multiplyer-in-si/240908006240250/ [retrieved from the internet on Oct. 6, 2021] Jan. 15, 2016 (2 Pages).

Petzl; Fixe "Versatile compact pulley"; https://www.petzl.com/US/en/Professional/Pulleys/FIXE [retrieved from the internet on Oct. 6, 2021] Feb. 13, 2018 (3 pages).

Petzl; Rescue "High strength, very high efficiency pulley"; https://www.petzl.com/US/en/Professional/Pulleys/RESCUE [retrieved from the internet on Oct. 6, 2021] Feb. 13, 2018 (3 pages).

Petzl; Tandem® Speed "Efficient double pulley for zip lines or tensioned"; highlineshttps://www.petzl.com/US/en/Professional/Pulleys/TANDEM-SPEED [retrieved from the internet on Oct. 6, 2021] Feb. 13, 2018 (3 pages).

Rei Co-op Shop; R"esults for 'pulley'" https://www.rei.com/search?q=pulley [retrieved from the internet on Oct. 6, 2021] 2021 (5 pages).

Slack-Mountain; "Line Slider Slack Mountain"; https://slack-mountain.com/en/pulley-and-tension/61-poulie-de-sangle-slack-mountain.html [retrieved from the internet on Oct. 6, 2021] Jun. 9, 2020 (4 pages).

Slacktivity "HangOver-S | Screw-gate" https://slacktivity.com/shop/screw-gate-hangover/ [retrieved from the internet on Oct. 6, 2021] Feb. 11, 2021 (9 pages).

Spider Slacklines; Aidman Slackline Slider;5. https://spider-slacklines.com/shop/en/rollex/81-3458-aidman-slackline-slider-7325999090.html#/634-select_brake-rubber_pulley_brake [retrieved from the internet on Oct. 6, 2021] May 17, 2021 (7 pages).

Sumally; Landcrusing Highslide 2 Webbing Pulley "https://sumally.eom/p/2413315object_id=ref%3AkwHNRkSBoXDOACTTAw%3AMJEt" [retrieved from the internet on Oct. 6, 2021] May 11, 2017 (1 page).

WesSpur; "1/2" Capacity Pulleys"; /https://www.wesspur.com/pulleys/half-inch-pulleys.html [retrieved from the internet on Oct. 6, 2021] Mar. 15, 2005 (12 pages).

Zerge—Outdoor— "SKIP—The high-efficiency webbing pulley" http://zergeoutdoor.com/product/skip-the-high-efficiency-webbing-pulley/ [retrieved from the internet on Oct. 6, 2021] Nov. 12, 2016 (7 pages).

* cited by examiner

TROLLEY APPARATUS, SYSTEM, METHOD OF USE, AND METHOD OF MANUFACTURE

FIELD OF THE DISCLOSURE

This disclosure relates to a trolley apparatus, system, method of use, and method of manufacture.

BACKGROUND

"Slacklining" is a recreational activity that involves the act of walking, running or balancing along a suspended length of flat webbing that is tensioned between two anchors. Slacklining is similar to slack rope walking and/or tightrope walking. However, slacklines differ from tightwires and tightropes in the type of material used and/or the amount of tension applied during use. Typically, slacklines are tensioned significantly less than tightropes or tightwires in order to create a dynamic line which may stretch and bounce like a long and narrow trampoline.

SUMMARY

One or more aspects of the present disclosure relate to a trolley apparatus, in particular, a trolley apparatus configured for use with slackline webbing. The type of webbing used in slackline activities typically comprises a webbing that is wider and flatter than conventional tightwires and tightropes, as well as other conventional webbing (e.g., for straps). For example, a slackline webbing may have a width of about 3.8 centimeters (about 1.5 inches) to 5 centimeters (about 2 inches), or greater. A width in this range may be preferred over narrower widths since the activity of slacklining typically involves a user walking barefoot across the webbing.

The slackline webbing is first made taunt across two anchors. The tensioning may involve using one or more of pulleys, ratcheting buckles, and/or other components. In some instances, pulleys may be attached to tensioning straps coupled to the ends of the webbing and the respective anchors. These tensioning straps are typically narrower than the slackline webbing. For example, the tensioning straps may comprise a 1 inch wide webbing (e.g., around 2.5 centimeters) material. Accordingly, the pulleys themselves are also sized and dimensioned to accommodate the relatively narrower tensioning straps. The straps and pulleys allows users to get the slackline webbing relatively taunt, as may be desired in some forms of the activity. One notable characteristics of pulleys that operate to tension slackline webbings via narrower straps is that they are not dimensioned to operate with the width of the slackline webbing—meaning the slackline webbing itself cannot be fed through the pulley.

A trolley may be a device that is suspended by a line of material that is anchored at two ends, such as traditionally known zipline trolleys. The traditional zipline trolley may comprise of a set of rollers or wheels that are positioned to roll along the line of material. However, the line of material that traditional zipline trolleys use are steel wire cables.

In recent years, some users have adapted slacklines (or webbing having the same or similar width) to facilitate other types of recreational activities. For example, some users may affix handles along at various distances along the length of a slackline to create "monkey bars" or some other jungle gym arrangement. In these activities, the users may hang below the slackline, swinging between the different handles.

The inventors of the present disclosure have identified that there has yet to be an implementation of a trolley that operates with a slackline webbing. While some users have adapted slacklines to include fixed handles, there has yet to be a trolley apparatus that can be used on a slackline. The pulleys used in tensioning slacklines via tensioning straps simply do not accommodate the width of a slackline webbing and cannot be utilized as a slackline trolley. The present disclosure proposes a trolley apparatus configured for a slackline webbing.

In some implementations, a trolley apparatus may comprise one or more of a first side plate, a second side plate, a support axle, one or more roller components, and/or other components. The first side plate may have one or more of a first end, a second end opposite the first end, a first interior surface, a first exterior surface opposite the first interior surface, and/or other components. The second side plate may have one or more of a third end, a fourth end opposite the third end, a second interior surface, a second exterior surface opposite the first interior surface, and/or other components. The support axle may be mounted through and/or between the first side plate and the second side plate. The support axle may be mounted such that the first side plate and the second side plate are at opposite ends of the support axle. The support axle may be configured to support the one or more roller components. In some implementations, a distance spanning between the first interior surface of the first side plate and the second interior surface of the second side plate may be greater than 3.8 centimeters. In some implementations, a distance spanning between the first interior surface of the first side plate and the second interior surface of the second side plate may be greater than five centimeters. The distance may be specifically set to allow the trolley apparatus to accommodate a slackline webbing which may have a width in a range of about 3.8 centimeters to around five centimeters, or greater.

In some implementations, a trolley system for entertainment may include a trolley apparatus, a webbing strap, and/or other components. The system may be configured for use by children as a recreational activity. However, modifications may be made to adapt the apparatus for users of any age.

The webbing strap may be configured to be tensioned between two anchors. The trolley apparatus may be configured to be supported by the webbing strap. The webbing strap may support the trolley apparatus by communicating the webbing strap between the first interior surface of the first side plate and the second interior surface of the second side plate such that the one or more roller components of the support axle sit atop the webbing strap.

A method of manufacture of a trolley apparatus may comprise one or more of: forming a first side plate; forming a second side plate; mounting a support axle through and/or between the first side plate and the second side plate; and/or other operations.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
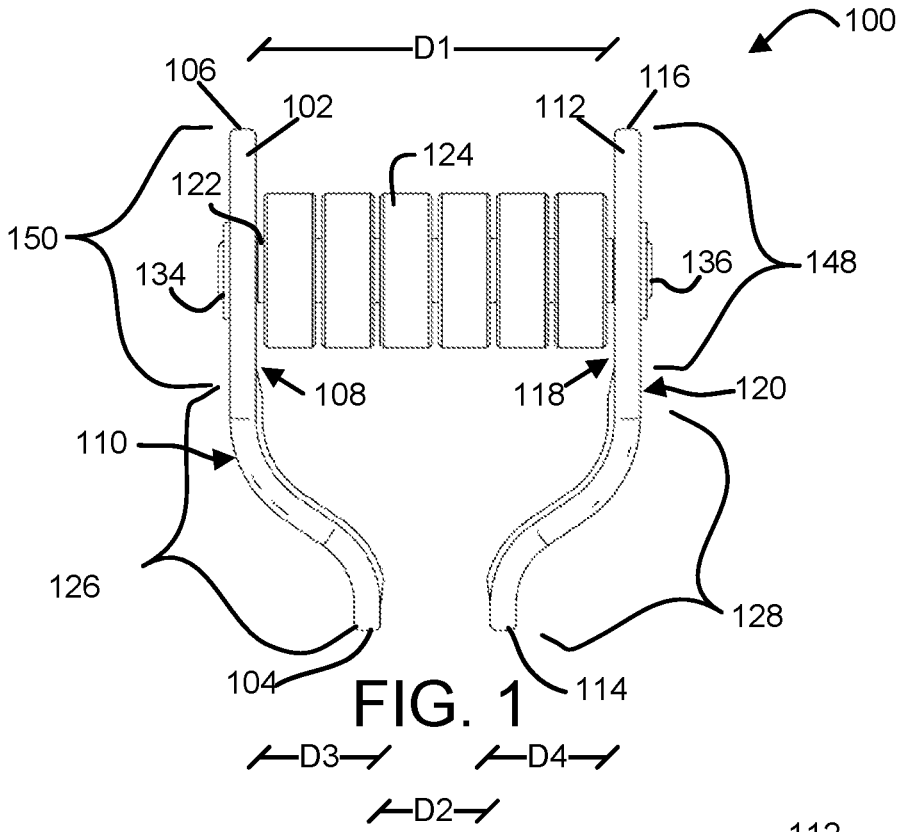
FIG. 1 illustrates a view of a trolley apparatus, in accordance with one or more implementations.

FIG. 1 illustrates a view of a trolley apparatus 100, in particular, an apparatus configured for use with slackline webbing. The type of webbing used in slackline activities typically comprises a webbing that is wider and flatter than conventional tightwires and tightropes. In some implementations, a slackline webbing may have a width of about 3.8 centimeters (about 1.5 inches) to 5 centimeters (about 2 inches). In some implementations, a slackline webbing may have a width greater than five centimeters. In some implementations, a slackline webbing may have a minimum width of about 5 centimeters.

It is noted that terms such as "left," "right," "upper," "lower," "top," "bottom," "proximal," "distal," and/or other direction terms herein may refer to conventional use of such terms as applied to conveying spatial orientation with respect to an as-used mode of the trolley apparatus 100 that may become apparent to a person of ordinary skill in the art upon reading this disclosure. The use of these terms with various components should therefore be easily understood by a person skilled in the art as related to orientation, direction, and/or disposition. Further, some directions may be specifically defined herein and/or shown in the figures.

In some implementations, trolley apparatus 100 may comprise one or more of a first side plate 102, a second side plate 112, a support axle 122, one or more roller components 124, and/or other components. In some implementations, first side plate 102 and/or second side plate 112 may be made from one or more materials. A material may include one or more of aluminum, aluminum alloy, steel, carbon fiber composite, and/or other materials. In some implementations, first side plate 102 and/or second side plate 112 may be formed by one or more of cutting, forging, bending, and/or other techniques. In some implementations, first side plate 102 and/or second side plate 112 may be made from forged aluminum alloy and/or other materials. In some implementations, first side plate 102 may be about half a centimeter thick. In some implementations, second side plate 112 may be about half a centimeter thick. In some implementations, first side plate 102 may be about a quarter of a centimeter thick. In some implementations, second side plate 112 may be about a quarter of a centimeter thick. In some implementations, trolley apparatus 100 may have a total mass of less than 500 grams. In some implementations, trolley apparatus 100 may have a total mass of about 200 grams.

It is noted that although the depiction of the trolley apparatus 100 in FIG. 1 (and other figures) shows the trolley apparatus 100 as assembled, this is for illustrative purposes only. In some implementations, the trolley apparatus 100 may be provided as a kit of (non-assembled or substantially non-assembled) components. Such a kit may be provided to end users to assemble themselves.

First side plate 102 may have one or more of a first end 104 (e.g., bottom end), a second end 106 (e.g., top end) opposite first end 104, a first interior surface 108, a first exterior surface 110 opposite first interior surface 108, a first aperture (not shown in FIG. 1), and/or other components.

Second side plate 112 may have one or more of a third end 114 (e.g., a bottom end), a fourth end 116 (e.g., a top end) opposite third end 114, a second interior surface 118, a second exterior surface 120 opposite second interior surface 118, a second aperture (not shown in FIG. 1) and/or other components. First exterior surface 110 of first side plate 102 may face the same direction as second interior surface 118 of second side plate 112. First interior surface 108 of first side plate 102 may face the same direction as second exterior surface 120 of second side plate 112.

Support axle 122 may be mounted through and/or between first side plate 102 and second side plate 112. Support axle 122 may be mounted such that first side plate 102 and second side plate 112 are at opposite ends of support axle 122. Support axle 122 may be configured to support one or more roller components 124. In some implementations, support axle 122 may be machined stainless steel and/or other material. Support axle 122 may have one or more of a fifth end 134, a sixth end 136 (see, FIGS. 1 and/or 3) opposite fifth end 134, and/or other components. Fifth end 134 of support axle 122 may be disposed between first end 104 and second end 106 of first side plate 102. Sixth end 136 of the support axle 122 may be disposed between third end 114 and fourth end 116 of second side plate 112. In some implementations, fifth end 134 of support axle 122 may be disposed nearer second end 106 (e.g., top end) of first side plate 102 than first end 104 of first side plate 102. In some implementations, sixth end 136 of support axle 122 may be disposed nearer fourth end 116 (e.g., top end) of second side plate 112 than third end 114 of second side plate 112. In some implementations, fifth end 134 of support axle 122 may be disposed at the second end 106 (e.g., top end) of first side plate 102. In some implementations, sixth end 136 of support axle 122 may be disposed at the fourth end 116 (e.g., top end) of second side plate 112.

In some implementations, a portion of fifth end 134 may be visible alongside first exterior surface 110 (e.g., a press fit element that mounts fifth end 134 to first side plate 102). In some implementations, a portion of sixth end 136 may be visible alongside second exterior surface 120 (e.g., a press fit element that mounts sixth end 136 to second side plate 112). In some implementations support axle 122 may be comprised of a bolt or screw with fastening nuts at one or more ends. In some implementations, support axle 122 may comprise a machined axle with riveted heads. In some implementations, support axle 122 may include female threads that sits within a side plate, and bolts on both sides to attach. The support axle 122 may not be visible or extend through the side plates.

In some implementations, the one or more roller components 124 may be supported by support axle 122. By way of non-limiting illustration, the one or more roller components 124 may be press fit over support axle 122 and/or attached to support axle 122 in other ways. In some implementations, one or more roller components 124 may include one component. In some implementations, the support axle 122 itself may be a roller component. In some implementations, one or more roller components 124 may include two components. In some implementations, one or more roller components 124 may include three components. In some implementations, one or more roller components 124 may include four components. In some implementations, one or more roller components 124 may include five components. In some implementations, one or more roller components 124 may include six components. In some implementations, one or more roller components 124 may include seven components. In some implementations, one or more roller components 124 may include more than seven components. The description of "press fit" engagement of the one or more roller components 124 over support axle 122 is provided for illustrative purposes only. In some implementations, other types of engagement may be used, e.g., slide-on and/or other types of engagement.

In some implementations, an individual component of one or more roller components 124 may comprise a radial ball bearing and/or other devices. In some implementations, an individual component may have a diameter in the range of five millimeters to 100 millimeters. In some implementations, an individual component may have a diameter in the range of twenty millimeters to sixty millimeters. In some implementations, an individual component may have a diameter in the range of twenty millimeters to thirty five millimeters. In some implementations, an individual component may have a diameter in the range of thirty millimeters to forty millimeters. In some implementations, an individual component may have a diameter of about thirty five millimeters. In some implementations, an individual component may have a diameter of about thirty two millimeters. In some implementations, an individual component may have a diameter of about twenty four millimeters. In some implementations, an individual component may have a diameter of greater than 100 millimeters. In some implementations, the larger the diameter, the smoother, faster, and/or more efficient the ride may be.

In some implementations, an individual component may be made of one or more of stainless steel, aluminum alloy, plastic, and/or other materials. In some implementations, an individual component may be about one centimeter in width. In some implementations, an individual component may span the spacing (e.g., D1) between first interior surface 108 of the first side plate 102 and second interior surface 118 of the second side plate 112 (see, e.g., FIG. 7). In some implementations, individual components of one or more roller components 124 may be evenly spaced along support axle 122. In some implementations, spacers may be implemented between individual components to rigidize the support axle 122 including the one or more roller components 124. In some implementations, one or more roller components 124 may be coated in a polymer and/or other material to provide abrasion resistance against the webbing of a slackline after repeated use.

In FIG. 1, in some implementations, a distance D1 may correspond to a spacing between the first interior surface 108 of first side plate 102 and the second interior surface 118 of second side plate 112. The trolley apparatus 100 may be constructed such that the distance D1 may allow trolley apparatus 100 to accommodate a slackline webbing (not depicted in FIG. 1) which may have a width in the range of 3.8 to five centimeters, or more. In some implementations, distance D1 may be about 3.8 centimeters. In some implementations, distance D1 may be greater than 4.5 centimeters. In some implementations, distance D1 may be about 4.5 centimeters. In some implementations, distance D1 may be about five centimeters. In some implementations, distance D1 may be greater than five centimeters. In some implementations, distance D1 may be about 5.25 centimeters. In some implementations, distance D1 may be at least 5.25 centimeters. In some implementations, distance D1 may be greater than 5.25 centimeters. In some implementations, distance D1 may be about five and one half centimeters (e.g., 2.2 inches). In some implementations, distance D1 may be in a range of about 4.5 centimeters to 5.5 centimeters. In some implementations, distance D1 may be at least 5.5 centimeters. In some implementations, distance D1 may be greater than 5.5 centimeters.

In some implementations, the first side plate 102 may include one or more of a first portion 126 (e.g., bottom portion), a fourth portion 150 (e.g., top portion), and/or other portions. The first portion 126 and the fourth portion 150 may comprise respective halves of the first side plate 102 (e.g., top and bottom halves). In some implementations, the fourth portion 150 of the first side plate 102 may be adjacent to second end 106.

In some implementations, the second side plate 112 may include one or more of a second portion 128 (e.g., bottom portion), a third portion 148 (e.g., top portion), and/or other portions. The second portion 128 and the third portion 148 may comprise respective halves of the second side plate 112. In some implementations, the third portion 148 of second side plate 112 may be adjacent to fourth end 116.

In some implementations, the first portion 126 of first side plate 102 adjacent first end 104 may be bent toward second side plate 112. In some implementations, the second portion 128 of second side plate 112 adjacent third end 114 may be bent toward first side plate 102. In some implementations, the respective bends may be a straight line bend and/or curvilinear bend. By way of non-limiting illustration, first portion 126 of first side plate 102 adjacent first end 104 may curve toward second side plate 112. In some implementations, the second portion 128 of second side plate 112 adjacent third end 114 may curve toward first side plate 102.

In some implementations, the bends of the various portions may define a second distance D2. The second distance D2 may define a distance spanning between first end 104 and third end 114. In some implementations, distance D2 may be in the range of zero to five centimeters. Distance D2 being about zero centimeters may mean first end 104 and third end 114 may be touching, or relatively close. In some implementations, the second distance D2 may be about two centimeters. In some implementations, second distance D2 may be eighteen millimeters (0.7 inches). In some implementations, the second distance D2 may be about three centimeters. In some implementations, the second distance D2 may be less than three centimeters.

In some implementations, first end 104 of the first side plate 102 may be offset from the second end 106 of the first side plate 102 by a third distance D3. In some implementations, third distance D3 may be in the range of zero to 2.5 centimeters. In some implementations, third distance D3 may be in the range of 1.5 to 2.5 centimeters. In some implementations, third distance D3 may be about 2.5 centimeters. In some implementations, third distance D3 may be greater than 2.5 centimeters. In some implementations, third distance D3 may be about two centimeters. In some implementations, third distance D3 may be about eighteen to nineteen millimeters. In some implementations, third distance D3 may be eighteen and one half millimeters. In some implementations, third distance D3 may be measured along a direction that is parallel with a central axis of support axle 122. In some implementations, third distance D3 may be measured from first interior surface 108 in first portion 126 to first interior surface 108 in fourth portion 150 of first side plate 102. In some implementations, third distance D3 may be measured from centerlines of first side plate 102 in first portion 126 and in fourth portion 150.

In some implementations, third end 114 of second side plate 112 may be offset from the fourth end 116 of the second side plate 112 by a fourth distance D4. In some implementations, fourth distance D4 may be in the range of zero to 2.5 centimeters. In some implementations, fourth distance D4 may be in the range of 1.5 to 2.5 centimeters. In some implementations, fourth distance D4 may be about 2.5 centimeters. In some implementations, fourth distance D4 may be greater than 2.5 centimeters. In some implementations, fourth distance D4 may be about two centimeters. In some implementations, fourth distance D4 may be about eighteen to nineteen millimeters. In some implementations, fourth distance D4 may be eighteen and one half millimeters. In some implementations, fourth distance D4 may be measured along a direction that is parallel with a central axis of support axle 122. In some implementations, fourth distance D4 may be measured from second interior surface 118 in second portion 128 to second interior surface 118 in third portion 148 of second side plate 112. In some implementations, fourth distance D4 may be measured from centerlines of second side plate 112 in second portion 128 and in third portion 148. In some implementations, distances D2, D3, and D4 may each comprise about one third of distance D1.

In some implementations, trolley apparatus 100 may be constructed such that a difference between D1 and D2 is greater than a threshold. In some implementations, the threshold may be in the range of zero to 5.5 centimeters. A threshold of zero may mean that D1 and D2 are about the same distance—this may be accomplished by having first side plate 102 and second side plate 112 that are relatively flat (e.g., little or no curve or bend). In some implementations, the threshold may be about 3 centimeters. In some implementations, the threshold may be greater than 5.5 centimeters.

In some implementations, the use of the term "about" may apply to one or more described numeric values, whether or not explicitly indicated. Those skilled in the art may appreciate that use of "about" does not render the aforementioned numeric values indefinite, but instead may understand that the numeric values convey an intended or desired value where some deviation and/or tolerance may be acceptable without departing from the spirit and intent of the disclosure. This term may generally refer to a range of numbers that one of ordinary skill in the art would consider as a reasonable amount of deviation and/or tolerance from the recited numeric values (i.e., having the equivalent function or result). For example, without limitation, this term may be construed as including a deviation of one or more of ±0.1 millimeters, ±0.2 mm, ±0.5 millimeters, ±1 millimeter, ±2 millimeters, and/or other such deviations and/or tolerance that may be understood by a person of ordinary sill in the art as acceptable without altering an intended function or result of the apparatus.

Figure 7:
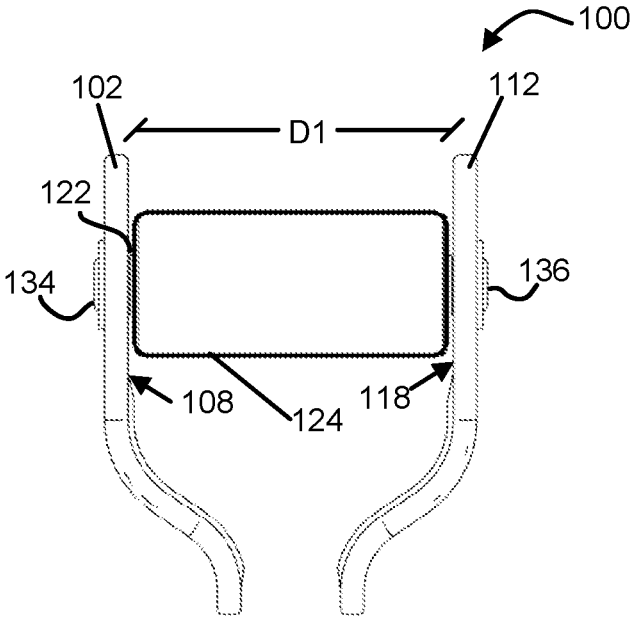
FIG. 7 illustrates a view of a trolley apparatus, in accordance with one or more implementations.

FIG. 7 illustrates a view of trolley apparatus 100, which may include the same and/or similar components as trolley apparatus 100 of FIG. 1. In some implementations, the one or more roller components 124 may be a single component. In some implementations, a width of roller component 124 may span from first interior surface 108 of first side plate 102 to second interior surface 118 of second side plate 112. As such, the width of the single component may be the same as, or slightly less than, the first distance D1. For example, the width of the single component may be one or two millimeters less than the first distance D1. In some implementations, the single component may be made of metal, such as aluminum, and/or other material. In some implementations, the single component may be coated in a polymer and/or other material. In some implementations, one or more roller components 124 may be comprised of a continuous rolling surface supported by one or more rolling elements (e.g., bearings, bushings, and/or other elements). By way of non-limiting illustration, one or more roller components 124 may include one or more bearings over the support axle and a cylindrical (or substantially cylindrical) sleeve over the one or more bearings. The outer surface of the cylindrical sleeve may provide a continuous rolling surface. A substantially cylindrical sleeve may have ends that taper up and/or that include a relatively larger rim to help contain the webbing and/or keep the trolley apparatus 100 in line with the webbing.

Figure 2:
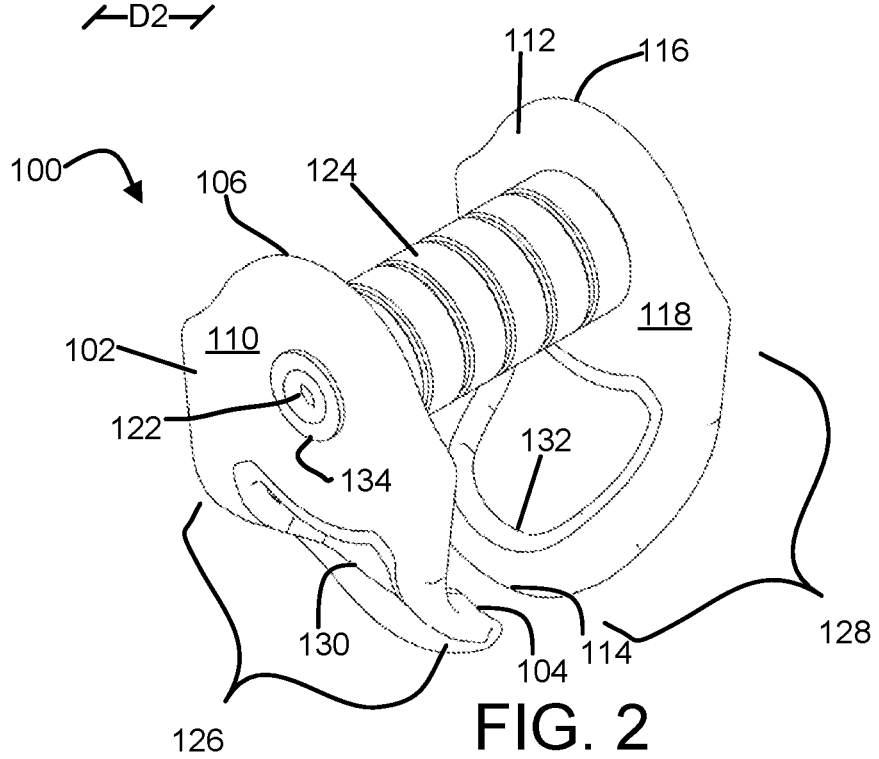
FIG. 2 illustrates a view of a trolley apparatus, in accordance with one or more implementations.
Figure 3:
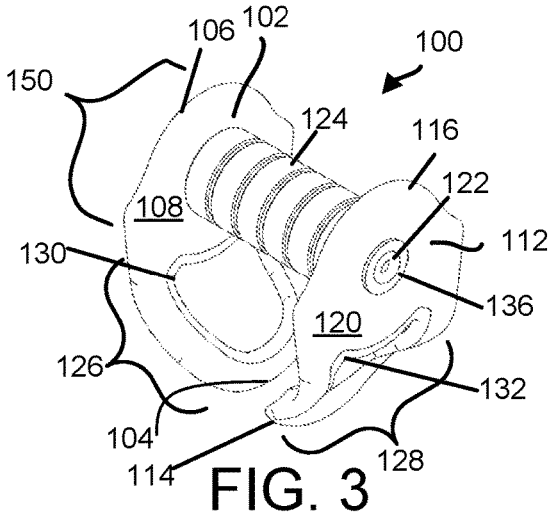
FIG. 3 illustrates a view of a trolley apparatus, in accordance with one or more implementations.

FIG. 2 and FIG. 3 illustrates perspective views of trolley apparatus 100 of FIG. 1. In some implementations, first portion 126 of first side plate 102 may include a first aperture 130. In some implementations, second portion 128 of the second plate 112 may include a second aperture 132. In some implementations, the second aperture 132 of second side plate 112 may mirror first aperture 130 of first side plate 102. In some implementations, the second aperture 132 of second side plate 112 may have a different shape and/or contour than the first aperture 130 of first side plate 102. In some implementations, first aperture 130 may be positioned nearer first end 104 (e.g., bottom end) of first side plate 102. The second aperture 132 may be positioned nearer third end 114 (e.g., bottom end) of second side plate 112. In some implementations, the first aperture 130 and second aperture 132 may be dimensioned to enable a coupling component (see e.g., FIG. 6) to be secured through first aperture 130 and second aperture 132. In some implementations, the first portion 126 of the first side plate 102 may be defined by the location and/or disposition of the first aperture 130. In some implementations, the second portion 128 of the second side plate 112 may be defined by the location and/or disposition of the second aperture 132.

Figure 4:
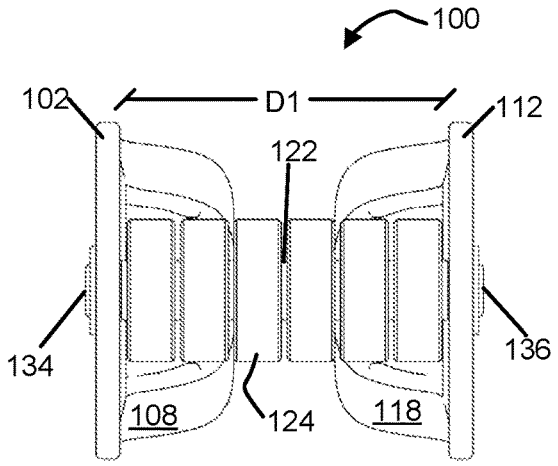
FIG. 4 illustrates a view of a trolley apparatus, in accordance with one or more implementations.
Figure 5:
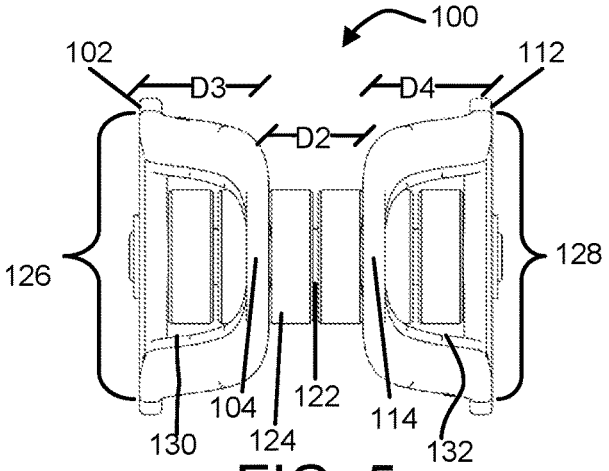
FIG. 5 illustrates a view of a trolley apparatus, in accordance with one or more implementations.

FIG. 4 illustrates a top view of trolley apparatus 100 of FIG. 1. As shown, support axle 122 may support one or more roller components 124 in the space defined by distance D1. Fifth end 134 may be mounted through and/or in contact with first side plate 102. Sixth end 136 may be mounted through and/or in contact with second side plate 112. In some implementations, a length of support axle 122 may span longer than first distance D1 that spans between first interior surface 108 and second interior surface 118. In some implementations, the length of support axle 122 may be about the same as first distance D1. FIG. 5 illustrates a bottom view of trolley apparatus 100 of FIG. 1 including like components referenced by like numerals.

Figure 6:
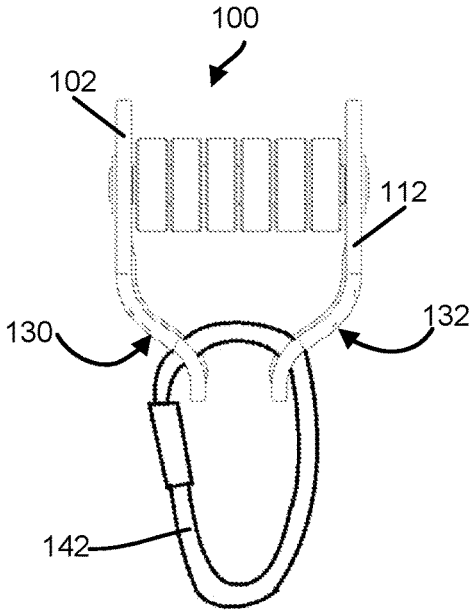
FIG. 6 illustrates a view of a trolley apparatus, in accordance with one or more implementations.

FIG. 6 illustrates a view of trolley apparatus 100 of FIG. 1 coupled to a coupling component 142. Coupling component 142 may comprise a loop with a gate opening. In some implementations, the loop may have a D-shape, an oval shape, a pear shape, a triangle shape, and/or other shapes. In some implementations, coupling component 142 may be steel, aluminum, plastic, and/or other materials. The gate opening may enable coupling component 142 to hook onto or otherwise couple with one or more apertures of various items, e.g., first aperture 130 and second aperture 132 of trolley apparatus 100. In some implementations, the gate opening may be spring loaded to close the loop. In some implementations, the gate opening may be auto locking, manual locking, or non-locking. The auto locking gating opening may include a circular sleeve around the gate opening that automatically twists and springs up to close and secure the loop. The auto locking gate opening may require the sleeve around the gating opening to be twisted and/or pulled down, and the gate opening to be pushed inward in order to open the loop. The manual locking may require the circular sleeve to be manually rotated in one direction to unlock the gate opening and the gate opening pushed inward to open the loop. In some implementations, the manual gate opening may require the circular sleeve to be manually rotated in an opposite direction to lock the gate opening. A non-locking gate opening may merely be a spring-loaded gate opening that closes the loop and requires pushing the gate opening inward to open the loop and thus coupling component 142. In some implementations, the gate may include a screw locking mechanism. In use, coupling component 142 may communicate through the first aperture 130 and the second aperture 132 of trolley apparatus 100.

Figure 8:
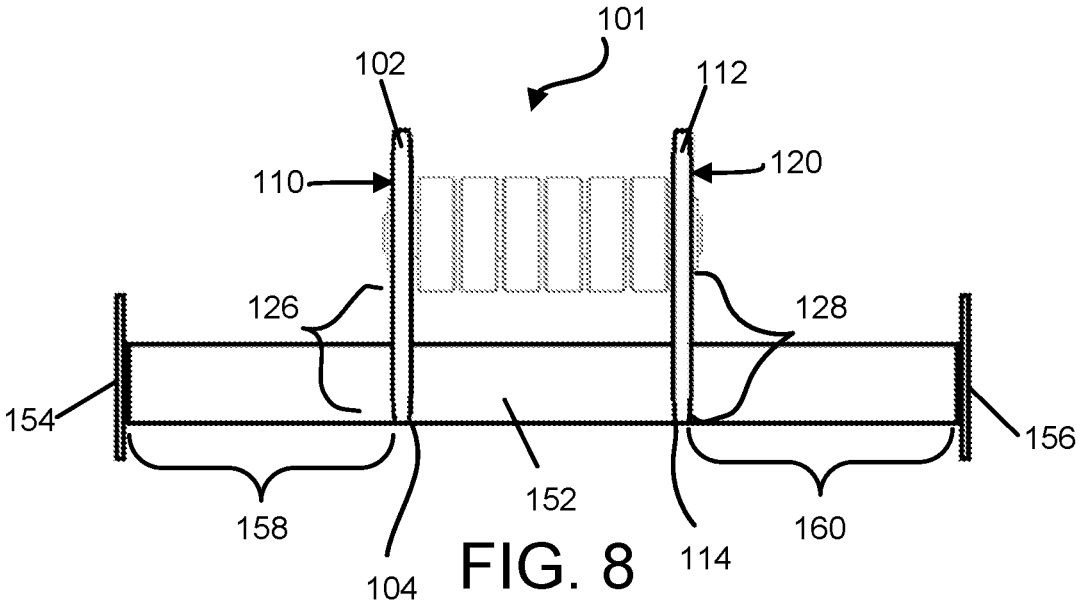
FIG. 8 illustrates a view of a trolley apparatus, in accordance with one or more implementations.

FIG. 8 illustrates a view of another implementation of a trolley apparatus 101 in a use case. Trolley apparatus 101 may be the same and/or similar to trolley apparatus 100 in FIG. 1. By way of non-limiting illustration, use of the same reference numerals may indicate the same components as shown and/or described with respect to FIG. 1 and/or other figures. In some implementations, trolley apparatus 101 may include a handlebar component 152. In some implementations, handlebar component 152 may be coupled to the first side plate 102 and the second side plate 112 via the bottom portions thereof e.g., (first portion 126 and second portion 128, respectively). In some implementations, handlebar component 152 may evenly extended out from first side plate 102 and second plate 112. In some implementations, handlebar component 152 may be formed of two components such that there may be a split in the middle for easier attachment to the webbing. In some implementations, a length of handlebar component 152 may be measured from an end 154 to an end 156. In some implementations, the length may be about 30 centimeters, or other lengths. A portion 158 of handlebar component 152 may comprise a first gripping portion upon which a user may hold. A portion 160 of handlebar component 152 may comprise a second gripping portion upon which a user may hold.

Figure 9:
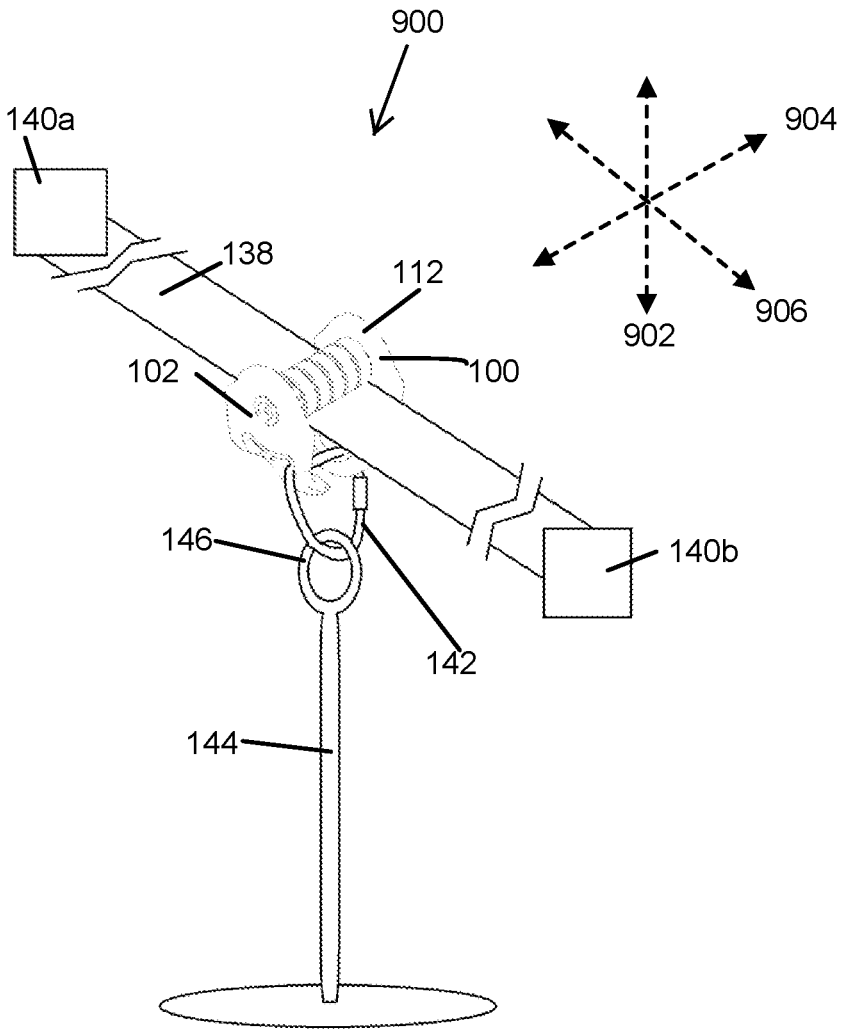
FIG. 9 illustrates a trolley system, in accordance with one or more implementations.

FIG. 9 illustrates a trolley system 900 for recreational entertainment, in accordance with one or more implementations. The system 900 may include one or more of a webbing strap 138, a trolley apparatus 100, a coupling component 142, a user-suspension component 144, and/or other components. Trolley apparatus 100 may be the same or similar to trolley apparatus 100, trolley apparatus 101, and/or other implementations shown and described herein.

Webbing strap 138 may span between anchors 140*a* and 140*b*. By way of non-limiting illustration, anchors 140*a* and 140*b* may be trees, poles, posts, walls, or other anchors that enable webbing strap 138 to have tension therebetween. In some implementations, webbing strap 138 may be configured of nylon, polyester, and/or other synthetic materials, and/or other non-synthetic materials. Webbing strap 138 may run under one or more roller components 124 so that one or more roller components 124 may rest or roll across or along webbing strap 138.

In use, coupling component 142 may communicate through first aperture 130 and second aperture 132. User-suspension component 144 may have a coupling end 146. Coupling end 146 may be configured to attach to coupling component 142. In some implementations, coupling end 146 may be a circle shape, an oval shape, a square shape, or other shape. Thus, trolley apparatus 100 may be coupled with coupling component 142 and coupling component 142 may be coupled with coupling end 146 of user-suspension component 144. As such, a user may sit on user-suspension component 144, stand on portions of user-suspension component 144, or suspend from user-suspension component 144 and roll across webbing strap 138 between anchor 140*a* and anchor 140*b*, and/or from an anchor to one or more intermediate points therebetween.

FIG. 9 further illustrates an exemplary coordinate system for describing features of the trolley apparatus 100. For example, the coordinate system may include a set of three orthogonal axes, 902, 904, and 906. Axis 902 may represent a direction of gravity. Axis 902 may provide a reference when defining features such as "bottom" and "top" features. Axis 906 may represent a direction of travel of trolley apparatus 100 upon the webbing strap 138. Axis 906 may provide a reference when defining features such as "front" and "back" features. Axis 904 may represent a transverse axis that is orthogonal to the direction of travel. Axis 904 may provide a reference when defining features such as "left", "right", and "distal" features. Axis 904 may coincide with a central axis of the support axle of the trolley apparatus 100.

Figure 10:
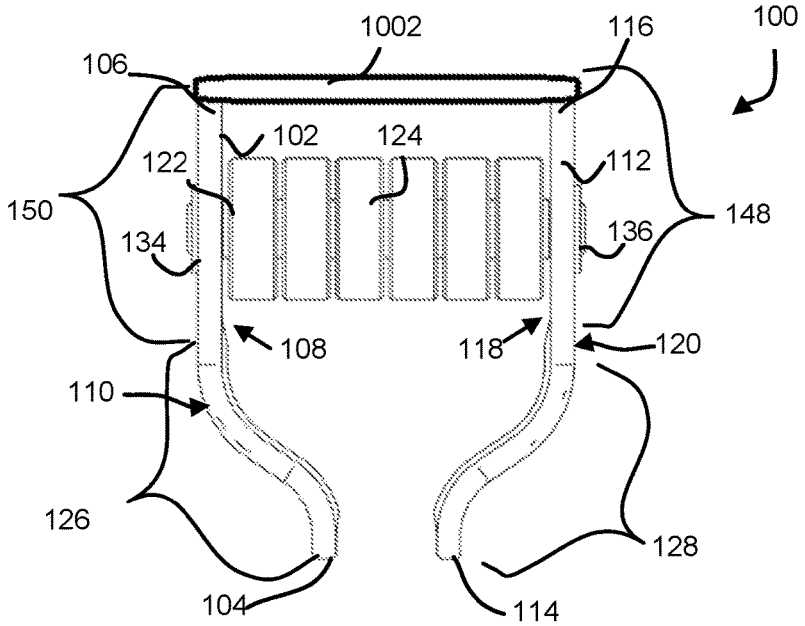
FIG. 10 illustrates a view of a trolley apparatus, in accordance with one or more implementations.

FIG. 10 illustrates a view of a trolley apparatus 100, in accordance with one or more implementations. Trolley apparatus 100 in FIG. 10 may include the same and/or similar components as trolley apparatus 100 and/or 101 shown in other figures and described herein. Like reference numerals may refer to like components shown and described herein. In the implementation of trolley apparatus 100 in FIG. 10, an enclosure member 1002 may be provided. The enclosure member 1002 may extend between second end 106 of first side plate 102 and fourth end 116 of second side plate 112. In some implementations, enclosure member 1002 may comprise one or more of a plate, a bar, and/or other component that is coupled to, or part of, second end 106 of first side plate 102 and fourth end 116 of second side plate 112 so that it may extend therebetween. In some implementations, enclosure member 1002, first side plate 102, and second side plate 112 may comprise a single piece of material. The enclosure member 1002 may enclose a space between one or more roller components 124 and the top ends of first side plate 102 and second side plate (e.g., second end 106 of first side plate 102 and fourth end 116 of second side plate 112). The enclosure member 1002 may act to further rigidize the trolley apparatus 100.

Figure 11:
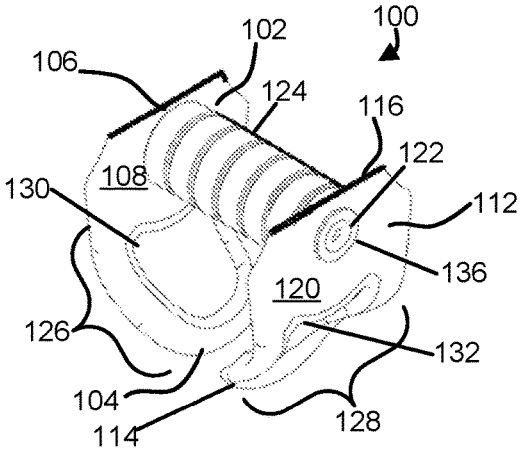
FIG. 11 illustrates a view of a trolley apparatus, in accordance with one or more implementations.

FIG. 11 illustrates a view of a trolley apparatus 100, in accordance with one or more implementations. Trolley apparatus 100 in FIG. 11 may include the same and/or similar components as trolley apparatus 100 and/or 101 shown in other figures and described herein. Like reference numerals may refer to like components shown and described herein. The trolley apparatus 100 in FIG. 11 illustrates an implementation where the second end 106 of first side plate 102 and fourth end 116 of second side plate 112 are truncated as opposed to rounded or curved as shown in other figures. Indeed, other shapes of second end 106 of first side plate 102 and fourth end 116 of second side plate 112 are also contemplated.

Figure 12:
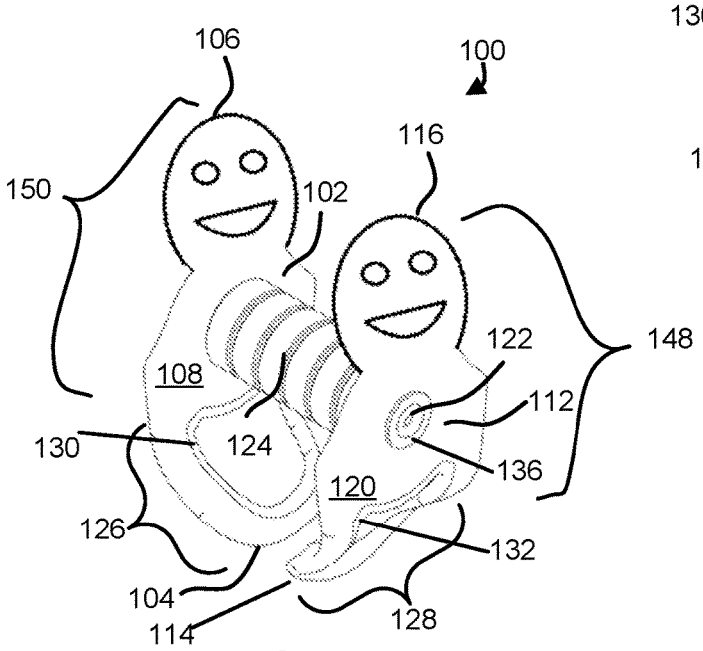
FIG. 12 illustrates a view of a trolley apparatus, in accordance with one or more implementations.

FIG. 12 illustrates a view of a trolley apparatus 100, in accordance with one or more implementations. Trolley apparatus 100 in FIG. 12 may include the same and/or similar components as trolley apparatus 100 and/or 101 shown in other figures and described herein. Like reference numerals may refer to like components shown and described herein. The trolley apparatus 100 in FIG. 12 illustrates an implementation where the second end 106 of first side plate 102 and fourth end 116 of second side plate 112 are formed to depicted one or more fanciful characters or shapes. It is noted that smiley faces are shown for illustrative purposes only and are not to be considered limiting. Instead, other shapes and/or characters are contemplated. Further, although the two faces are shown as symmetrical on each side, in some implementations fanciful characters or shapes may be different on each side.

Figure 13:
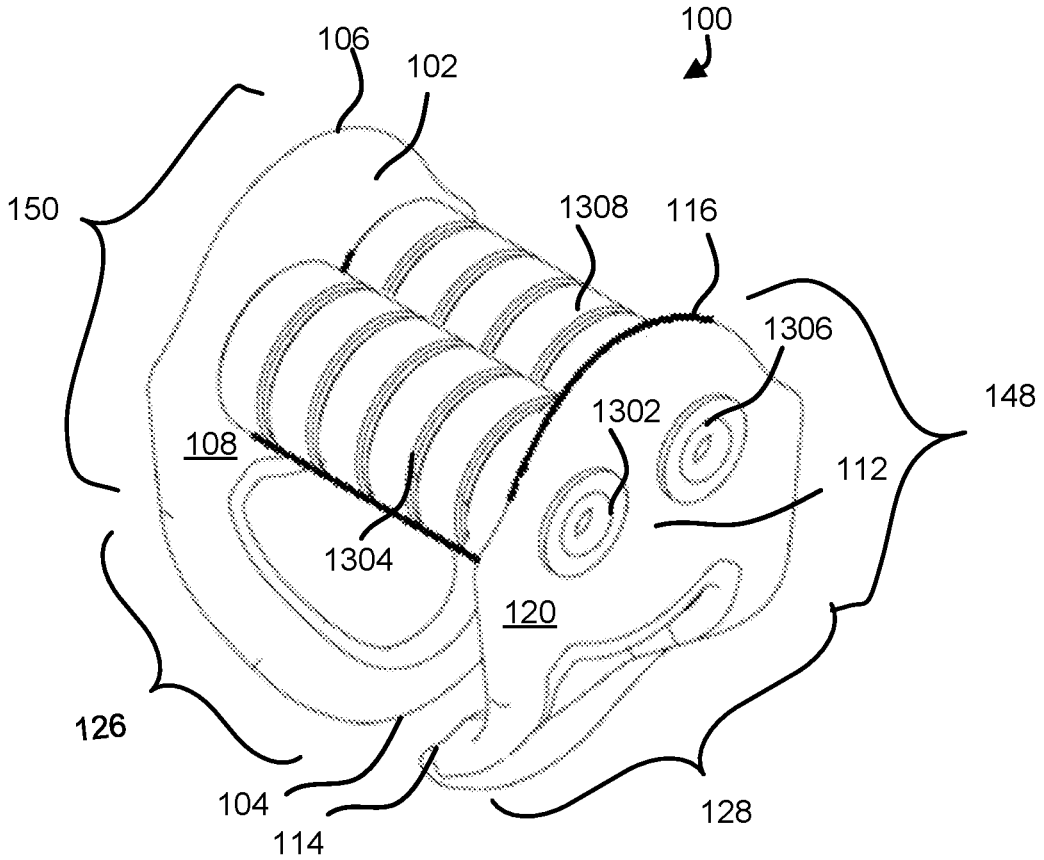
FIG. 13 illustrates a view of a trolley apparatus, in accordance with one or more implementations.

FIG. 13 illustrates a view of trolley apparatus 100, in accordance with one or more implementations. Trolley apparatus 100 in FIG. 13 may include the same and/or similar components as trolley apparatus 100 and/or 101 shown in other figures and described herein. Like reference numerals may refer to like components shown and described herein. The trolley apparatus 100 in FIG. 13 illustrates an implementation comprising more than one support axle supporting one or more roller components. By way of non-limiting illustration, the trolley apparatus 100 may include one or more of a first support axle 1302 supporting a first set of one or more roller components 1304, a second support axle 1306 supporting a second set of one or more roller components 1308, and/or other components. In some implementations, the first support axle 1302 and the second support axle 1306 may be disposed and arranged such that they are "in line" with the direction of travel of the trolley apparatus 100 when in use (see, e.g., FIG. 9). However other arrangements are possible. The use of more than one support axle supporting roller component(s) may provide for increased surface area of contact with a webbing during use. This may provide smoother ride experiences and/or more stability experienced by the rider. In some implementations, the two support axles may be spaced apart a distance. The distance may be in the range of 2.5 centimeters to 15 centimeters, or more. In some implementations, a handlebar may be positioned on the side plates in-between and below the two support axles.

Figure 14:
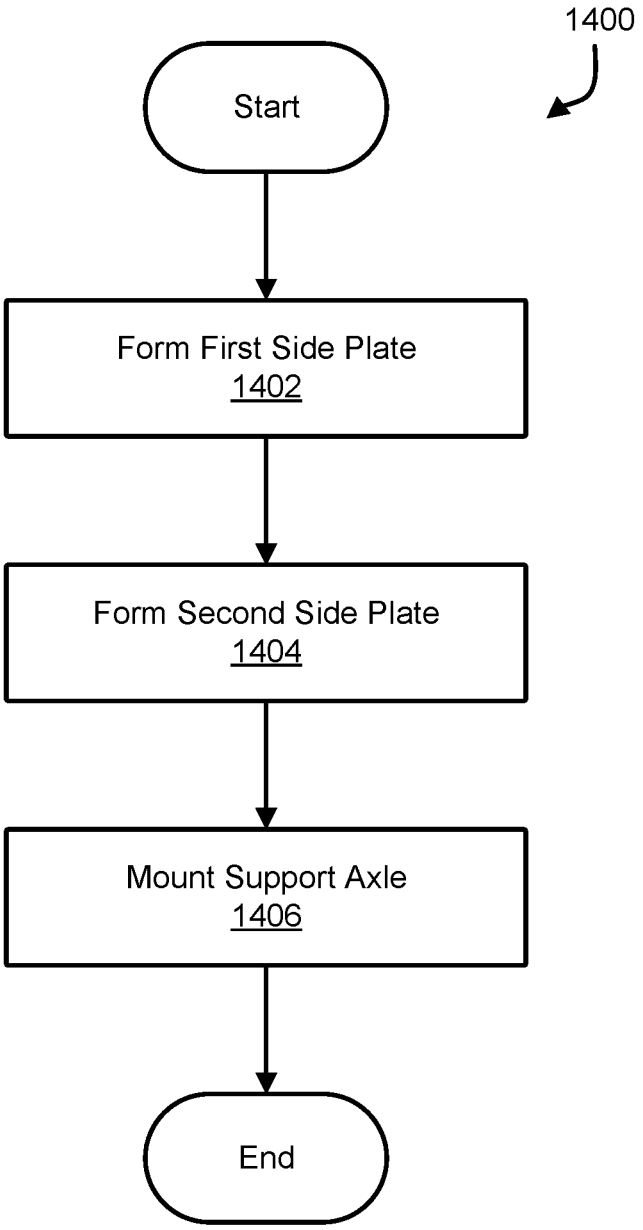
FIG. 14 illustrates a method of manufacture of a trolley apparatus.

FIG. 14 illustrates a method 1400 of manufacture of a trolley apparatus, in accordance with one or more implementations. The operations of method 1400 presented below are intended to be illustrative. In some implementations, method 1400 may be accomplished with one or more additional operations not described, and/or without one or more of the operations discussed. Additionally, the order in which the operations of method 1400 are illustrated in FIG. 14 and described below is not intended to be limiting.

In some implementations, method 1400 may be implemented using manual and/or automated manufacturing techniques. A manual manufacturing technique may include one or more forming techniques used by skilled artisans in manufacture. Forming techniques may include one or more of cutting, casting, extruding, grinding, bending, forging, stamping, turning, additive manufacturing, powder metallurgy, metal injection molding, compression molding, drilling, riveting, screwing, welding, sanding, and/or other techniques. Other techniques known to skilled artisans are also within the scope of the present disclosure. An automated manufacturing technique may include machines and one or more processing devices. By way of non-limiting illustration, a machine may include one or more of plastic injection molding machine, CNC machine, CNC lathe, and/or other machines. A machine may include one or more processing device, non-transitory electronic storage, and/or other components. The one or more processing devices and/or machines may include one or more devices executing some or all of the operations of method 1400 in response to instructions stored electronically on electronic storage medium. The one or more processing devices and/or machines may include one or more devices configured through hardware, firmware, and/or software to be specifically designed for execution of one or more of the operations of method 1400.

An operation 1402 may form a first side plate. The first side plate may have one or more of a first end, a second end opposite first end, a first interior surface, a first exterior surface opposite the first interior surface, and/or other components. For example, the first side plate may be the same as or similar to first side plate 102 shown in the figures and described herein.

An operation 1404 may form a second side plate. The second side plate may have one or more of a third end, a fourth end opposite the third end, a second interior surface, a second exterior surface opposite the second interior surface, and/or other components. For example, the second side plate may be the same as or similar to second side plate 112 shown in the figures and described herein.

An operation 1406 may mount a support axle through and/or between the first side plate and the second side plate. The support axle may be mounted such that the first side plate and the second side plate may be at opposite ends of the support axle. The support axle may support one or more roller components. A distance spanning between the first interior surface of the first side plate and the second interior surface of the second side plate may be at least five centimeters and/or other distances. For example, the support axle may be the same as or similar to support axle 122, 1302, and/or 1306, shown in the figures and described herein.

Figure 15:
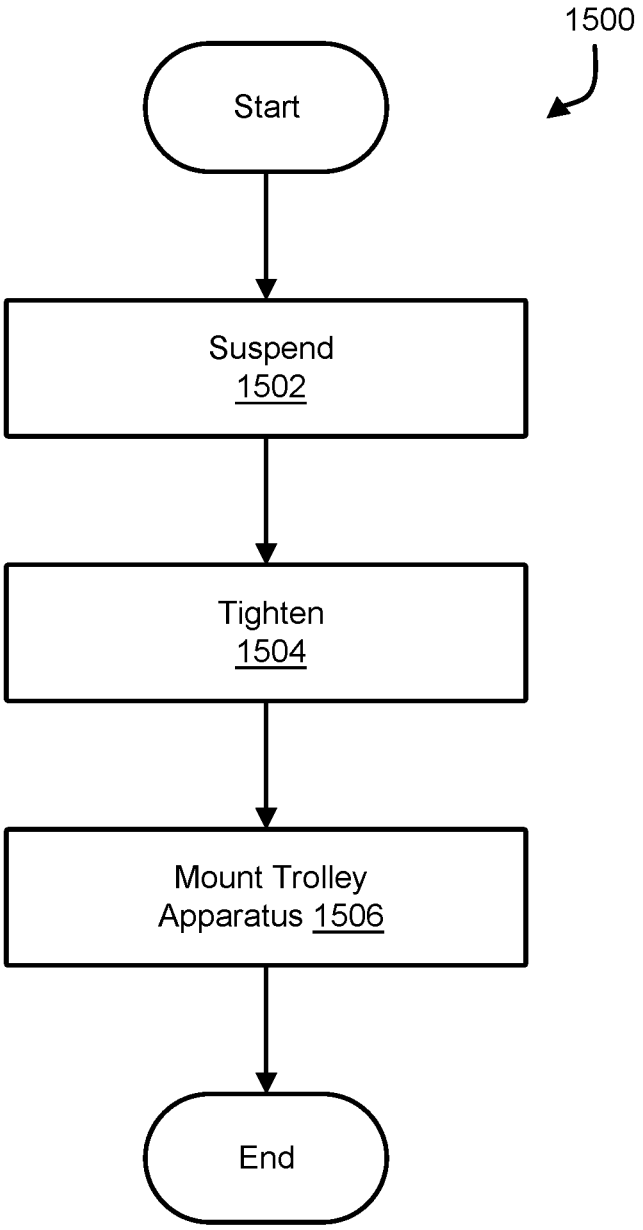
FIG. 15 illustrates a method of use of a trolley system.

FIG. 15 illustrates a method 1500 of use of a trolley system, in accordance with one or more implementations. The trolley system may include one or more of a webbing strap, a trolley apparatus, a coupling component, a user-suspension component, and/or other components. The trolley apparatus may be the same or similar to trolley apparatus 100, trolley apparatus 101, and/or other implementations shown and described herein. The operations of method 1500 presented below are intended to be illustrative. In some implementations, method 1500 may be accomplished with one or more additional operations not described, and/or without one or more of the operations discussed. Additionally, the order in which the operations of method 1500 are illustrated in FIG. 15 and described below is not intended to be limiting. In some implementations, method 1500 may be implemented by hand and/or using one or more tools.

An operation 1502 may suspend a webbing strap between two anchors.

An operation 1504 may tension the webbing strap to a desired tension.

An operation 1506 may mount the trolley apparatus to the webbing strap so that the webbing strap may run under one or more roller components of the trolley apparatus. The one or more roller components may rest on, or roll across or along, the webbing strap.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A trolley apparatus for exercise and recreational entertainment adapted to roll upon a flat webbing strap, the trolley apparatus comprising:

a first side plate, the first side plate having a first end, a second end opposite the first end, a first interior surface, and a first exterior surface opposite the first interior surface;

a second side plate, the second side plate having a third end, a fourth end opposite the third end, a second interior surface, and a second exterior surface opposite the second interior surface;

a support axle mounted through and/or between the first side plate and the second side plate such that the first side plate and the second side plate are at opposite ends of the support axle, the support axle supporting one or more roller components, the one or more roller components defining a rolling surface adapted to roll upon the flat webbing strap, an individual roller component of the one or more roller components having a circular cross section; and wherein a distance spanning between the first interior surface of the first side plate and the second interior surface of the second side plate is greater than four centimeters to accommodate a width of the flat webbing strap.

2. The trolley apparatus of claim 1, wherein the distance spanning between the first interior surface of the first side plate and the second interior surface of the second side plate is at least five centimeters.

3. The trolley apparatus of claim 1, wherein a first portion of the first side plate adjacent the first end curves toward the second side plate, and a second portion of the second side plate adjacent the third end curves toward the first side plate, and wherein a second distance spanning between the first end and the third end is less than three centimeters.

4. The trolley apparatus of claim 3, wherein the first portion of the first side plate includes a first aperture, and the second portion of the second plate includes a second aperture.

5. The trolley apparatus of claim 3, wherein the first end of the first side plate is offset from the second end of the first side plate by about one and one half centimeters to four centimeters, and the third end of the second side plate is offset from the fourth end of the second side plate by about one and one half to four half centimeters.

6. The trolley apparatus of claim 1, wherein a total mass of the trolley apparatus is less than 500 grams.

7. The trolley apparatus of claim 1, wherein the support axle has a fifth end and a sixth end opposite the fifth end, such that the fifth end of the support axle is disposed between the first end and the second end of the first side plate, and the sixth end of the support axle is disposed between the third end and the fourth end of the second side plate, wherein the fifth end of the support axle is disposed nearer the second end of the first side plate than the first end of the first side plate, and the sixth end of the support axle is disposed nearer the fourth end of the second side plate than the third end of the second side plate.

8. A trolley system for exercise and recreational entertainment, the trolley system comprising:

a flat webbing strap, the flat webbing strap being configured to be tensioned between two anchors;

a trolley apparatus, the trolley apparatus being configured to be supported by the flat webbing strap and being adapted to roll upon the flat webbing strap in an as-used mode of the trolley apparatus, the trolley apparatus comprising:

a first side plate, the first side plate having a first end, a second end opposite the first end, a first interior surface, and a first exterior surface opposite the first interior surface;

a second side plate, the second side plate having a third end, a fourth end opposite the third end, a second interior surface, and a second exterior surface opposite the second interior surface;

a support axle mounted through and/or between the first side plate and the second side plate such that the first side plate and the second side plate are at opposite ends of the support axle, the support axle supporting one or more roller components, the one or more roller components defining a rolling surface, an individual roller component of the one or more roller components having a circular cross section; and wherein the flat webbing strap supports the trolley apparatus by communicating the flat webbing strap between the first interior surface of the first side plate and the second interior surface of the second side plate such that the one or more roller components of the support axle sit atop the flat webbing strap in contact with the rolling surface in the as-used mode.

9. The trolley system of claim 8, wherein:

a distance spanning between the first interior surface of the first side plate and the second interior surface of the second side plate is in a range of four and one half centimeters to five and one half centimeters; and a first portion of the first side plate adjacent the first end curves toward the second side plate, and a second portion of the second side plate adjacent the third end curves toward the first side plate, and wherein a second distance spanning between the first end and the third end is less than three centimeters.

10. The trolley system of claim 9, further comprising:

a coupling component;

wherein the first portion of the first side plate includes a first aperture, and the second portion of the second plate includes a second aperture that mirrors the first aperture of the first side plate; and wherein the coupling component communicates through the first aperture and the second aperture.

11. The trolley system of claim 8, further comprising a user-suspension component, the user-suspension component having a coupling end configured to attach to a coupling component.

12. The trolley system of claim 10, wherein the first end of the first side plate is offset from the second end of the first side plate by about one and one half centimeters to four centimeters.

13. The trolley system of claim 8, wherein a total mass of the trolley apparatus is less than 500 grams.

14. The trolley system of claim 8, wherein the support axle has a fifth end and a sixth end opposite the fifth end, such that the fifth end of the support axle is disposed between the first end and the second end of the first side plate, and the sixth end of the support axle is disposed between the third end and the fourth end of the second side plate, and wherein the fifth end of the support axle is disposed nearer the second end of the first side plate than the first end of the first side plate, and the sixth end of the support axle is disposed nearer the fourth end of the second side plate than the third end of the second side plate.

15. A method of manufacture of a trolley apparatus for exercise and recreational entertainment adapted to roll upon a flat webbing strap, the method comprising:

forming a first side plate, the first side plate having a first end, a second end opposite the first end, a first interior surface, and a first exterior surface opposite the first interior surface;

forming a second side plate, the second side plate having a third end, a fourth end opposite the third end, a second interior surface, and a second exterior surface opposite the second interior surface;

mounting a support axle through and/or between the first side plate and the second side plate such that the first side plate and the second side plate are at opposite ends of the support axle, the support axle supporting one or more roller components, the one or more roller components defining a rolling surface adapted to roll upon the flat webbing strap, an individual roller component of the one or more roller components having a circular cross section; and wherein a distance spanning between the first interior surface of the first side plate and the second interior surface of the second side plate is at least four centimeters to accommodate a width of the flat webbing strap.

16. The method of claim 15, further comprising:

forming a first portion of the first side plate adjacent the first end such that the first portion curves toward the second side plate;

forming a second portion of the second side plate adjacent the third end such that the second portion curves toward the first side plate; and wherein a second distance spanning between the first end and the third end is about two centimeters.

17. The method of claim 16, further comprising:

forming a first aperture in the first portion of the first side plate; and forming a second aperture in the second portion of the second plate.

18. The method of claim 16, wherein the first end of the first side plate is offset from the second end of the first side plate by about one and one half centimeters to four centimeters.

19. The method of claim 15, wherein:

the support axle has a fifth end and a sixth end opposite the fifth end, such that the fifth end of the support axle is disposed between the first end and the second end of the first side plate, and the sixth end of the support axle is disposed between the third end and the fourth end of the second side plate; and the fifth end of the support axle is disposed nearer the second end of the first side plate than the first end of the first side plate, and the sixth end of the support axle is disposed nearer the fourth end of the second side plate than the third end of the second side plate.

20. A method of use of a trolley system for exercise and recreational entertainment, the trolley system comprising a flat webbing strap, a trolley apparatus adapted to roll upon the flat webbing strap, the trolley apparatus comprising a first side plate, a second side plate, and a support axle mounted through and/or between the first side plate and the second side plate including one or more roller components, the one or more roller components defining a rolling surface, an individual roller component of the one or more roller components having a circular cross section, the method comprising:

suspending the flat webbing strap between two anchors;

tensioning the flat webbing strap to a desired tension; and mounting the trolley apparatus to the flat webbing strap so that the flat webbing strap runs under the one or more roller components of the trolley apparatus in contact with the rolling surface.

* * * * *